US010769890B2

(12) United States Patent
Nelson et al.

(10) Patent No.: US 10,769,890 B2
(45) Date of Patent: Sep. 8, 2020

(54) SYSTEM AND METHOD FOR PROVIDING A GAME WITH SPLITTING SYMBOLS

(71) Applicant: Video Gaming Technologies, Inc., Franklin, TN (US)

(72) Inventors: Lyndsay Nelson, Reno, NV (US); Ryan Cuddy, Reno, NV (US); David Stoveld, Reno, NV (US)

(73) Assignee: VIDEO GAMING TECHNOLOGIES, INC., Franklin, TN (US)

( * ) Notice: Subject to any disclaimer, the term of this patent is extended or adjusted under 35 U.S.C. 154(b) by 692 days.

(21) Appl. No.: 14/497,968

(22) Filed: Sep. 26, 2014

(65) Prior Publication Data

US 2016/0093141 A1 Mar. 31, 2016

(51) Int. Cl.
*G07F 17/32* (2006.01)
*G07F 17/34* (2006.01)

(52) U.S. Cl.
CPC ..... *G07F 17/326* (2013.01); *G07F 17/34* (2013.01)

(58) Field of Classification Search
CPC ..... G07F 17/326
See application file for complete search history.

(56) References Cited

U.S. PATENT DOCUMENTS 6,726,204 B2 4/2004 Inoue
7,160,187 B2 1/2007 Loose et al.
7,438,639 B2 10/2008 Osawa
7,473,173 B2 1/2009 Peterson et al.
7,744,458 B2 6/2010 Marks et al.
7,922,573 B2 4/2011 Baerlocher et al.
8,979,639 B2 * 3/2015 Saunders ..... G07F 17/32 463/16
9,275,523 B1 3/2016 Hughes et al.
2004/0058727 A1 * 3/2004 Marks ..... G07F 17/3211 463/20
2005/0054420 A1 3/2005 Cregan et al.
2006/0068884 A1 * 3/2006 Baerlocher ..... G07F 17/3244 463/20
2008/0113735 A1 5/2008 Maya
2010/0029364 A1 2/2010 Zielinski
2013/0217463 A1 * 8/2013 Hughes ..... G07F 17/3244 463/20
2014/0256402 A1 * 9/2014 Caputo ..... G07F 17/34 463/20

* cited by examiner

*Primary Examiner* — Kang Hu
*Assistant Examiner* — Thomas H Henry
(74) *Attorney, Agent, or Firm* — Armstrong Teasdale LLP

(57) ABSTRACT

A gaming machine for providing a game of chance operable upon a wager by a player includes a plurality of reels associated with the game of chance. Each of the plurality of reels includes a plurality of reel positions to generate a symbol thereon. The gaming machine also includes a display comprising a defined plurality of positions to present a symbol thereon for each of the plurality of reels. The gaming machine further includes a processor programmed to generate a spin of the plurality of reels, resulting in a play area. The processor is also programmed to identify a splitting symbol in a first position on the play area, thereby activating the splitting symbol. The processor is further programmed to determine a second position on the play area that includes a splitting symbol as a result of the spin, and to display an additional splitting symbol in the second position.

17 Claims, 7 Drawing Sheets

902

SYSTEM AND METHOD FOR PROVIDING A GAME WITH SPLITTING SYMBOLS

BACKGROUND

The field of the disclosure relates generally to gaming systems, and, more particularly, to methods and systems for providing a game of chance with splitting symbols.

Conventionally, gaming machines provide games wherein a player has one or more opportunities to obtain a winning symbol combination on mechanical or video reels. At least some known games have a predetermined number of winning symbol combinations based on a predetermined set of symbols.

BRIEF DESCRIPTION

In one aspect, a gaming machine for providing a game of chance operable upon a wager by a player is provided. The gaming machine includes a plurality of reels associated with the game of chance. Each of the plurality of reels includes a plurality of reel positions to generate a symbol thereon. The gaming machine also includes a display comprising a defined plurality of positions to present a symbol thereon for each of the plurality of reels. The gaming machine further includes a processor. The processor is programmed to generate a spin of the plurality of reels. The spin results in a play area including one or more symbols generated from each of the plurality of reels. The processor is also programmed to identify a splitting symbol in a first position on the play area, thereby activating the splitting symbol. The processor is further programmed to determine a second position on the play area that includes a splitting symbol as a result of the spin. The processor is also programmed to display an additional splitting symbol in the second position.

In another aspect, a method for providing a game of chance operable upon a wager by a player is provided. The method is performed by a computing device including a display and a plurality of reels associated with the game of chance. Each of the plurality of reels includes a plurality of reel positions for generating a symbol thereon. The method includes generating a spin of the plurality of reels. The spin results in a play area including one or more symbols generated from each of the plurality of reels. The method also includes identifying a splitting symbol in a first position on the play area, thereby activating the splitting symbol. The method further includes determining a second position on the play area that includes a splitting symbol as a result of the spin. The method also includes displaying an additional splitting symbol in the second position.

In yet another aspect, a gaming system is provided. The gaming system includes a gaming machine. The gaming machine includes a plurality of reels associated with a game of chance. Each of the plurality of reels includes a plurality of reel positions to generate a symbol thereon. The gaming machine also includes a display comprising a defined plurality of positions to present a symbol thereon for each of the plurality of reels. The gaming system also includes a server comprising a processor. The processor is programmed to generate a spin of the plurality of reels. The spin results in a play area including one or more symbols generated from each of the plurality of reels. The processor is also programmed to identify a splitting symbol in a first position on the play area, thereby activating the splitting symbol. The processor is further programmed to determine a second position on the play area that includes a splitting symbol as a result of the spin. The processor is also programmed to display an additional splitting symbol in the second position.

BRIEF DESCRIPTION OF THE DRAWINGS

The embodiments described herein may be better understood by referring to the following description in conjunction with the accompanying drawings.

DETAILED DESCRIPTION

Figure 1:
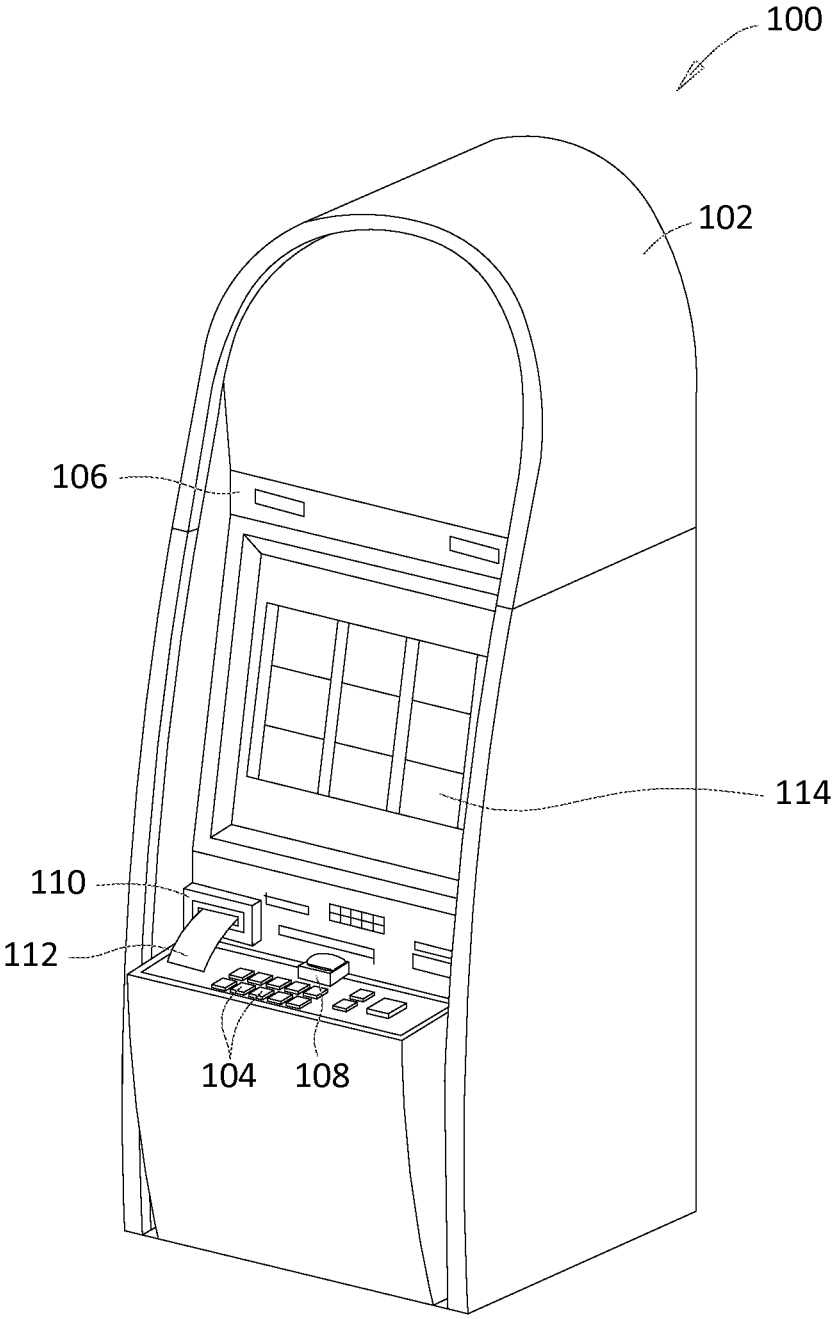
FIG. 1 is a schematic diagram of an exemplary gaming machine that enables play of a base game that includes splitting symbols.

The embodiments described herein relate generally to gaming systems and methods that provide games of chance to a player operating a gaming machine and, more particularly, to systems and methods for providing a game of chance with splitting symbols during game play. In one example embodiment, a gaming machine provides a slot machine style game having or simulating a plurality of reels. Each reel includes a plurality of positions, where each position includes an initial symbol. One or more of these symbols are designated as having a "splitting" property. Symbols having the splitting property are referred to herein as "splitting symbols."

During play, the gaming machine generates a first spin. After a first reel of the gaming machine stops, a first reel may display a symbol having the splitting property (a splitting symbol). When a splitting symbol appears on the first reel, that particular splitting symbol becomes an "activation splitting symbol." In other words, the appearance of that splitting symbol on the first reel activates the splitting feature for that particular symbol (e.g., leading to the splitting of that particular symbol on the other reels). On the other reels, one or more of the splitting symbols may appear on the play field. For each activated splitting symbol that appears, the gaming machine splits the activated splitting symbol. More specifically, in one embodiment, "splitting" a symbol includes displaying an additional similar symbol in the same position. For example, if "X" is the activated splitting symbol, and one "X" appears on the third reel (e.g., after the reel stops spinning), the gaming machine splits that "X" into two "X's" by displaying (e.g., adding) an additional "X" in that same position. As such, when the gaming machine processes awards (e.g., evaluating pay lines), some awards may take into account both symbols within that single position, and may provide greater rewards based on the additional symbol provided by the split.

In some embodiments, the gaming machine identifies one or more of the positions in which splitting occurred on the play field as a "sticky splitting position." During a subsequent spin, such as during a bonus spin, the gaming machine splits symbols that appear in the sticky splitting position(s). Continuing the example above, the gaming machine identifies the particular position in which the "X" was split into two "X's" as a sticky splitting position. After a bonus spin, another symbol "Y" appears in the sticky splitting position. The gaming machine then processes a split of that "Y", but still in light of the activated splitting symbol. More specifically, the sticky splitting position adds the activated splitting symbol into the sticky splitting position. In other words, that position would contain both a "Y" (e.g., the original symbol shown after the bonus spin) and an "X" (split out because of the sticky splitting position).

At least one of the technical problems addressed by this system includes: (i) overcoming computer-generated game content that is stale or unexciting to users; (ii) fixed-reel, fixed-position games providing limited variability or flexibility in game content and/or game action; and (iii) limited award potential based on fixed symbol positions.

Exemplary technical effects of the systems, methods, and apparatus described herein include at least one of: (a) generating a spin of the plurality of reels, the spin resulting in a play area including one or more symbols generated from each of the plurality of reels; (b) identifying a splitting symbol in a first position on the play area, thereby activating the splitting symbol; (c) determining a second position on the play area that includes the splitting symbol as a result of the spin; (d) displaying an additional splitting symbol in the second position; (e) identifying a splitting symbol in a first position on a first reel of the plurality of reels; (f) determining a second position not on the first reel; (g) evaluating the play area to determine an award for the player, wherein the evaluation includes the additional splitting symbol; (h) identifying a second splitting symbol in a third position on the play area, thereby activating the second splitting symbol; (i) determining a fourth position on the play area that includes a second splitting symbol as a result of the spin; (j) displaying an additional second splitting symbol in the fourth position; (k) activating the splitting symbol further based at least in part on a random number and a pre-determined chance of activation; (l) identifying the second position as a sticky position; (m) generating a second spin of the plurality of reels; (n) displaying an additional splitting symbol in the second position as a result of the second spin; and (o) displaying the additional splitting symbol in the second position prior to completion of the spin.

The technical effect achieved by this system is at least one or more of: (i) replicating an existing symbol on the play area, thereby providing more of those symbols on the play area; (ii) altering the symbols on the play area during or after a spin; (iii) displaying the splitting effects to the user during the play; and (iv) increasing award combinations.

FIG. 1 is a schematic diagram of an exemplary gaming machine 100 that enables play of a base game that includes splitting symbols. Gaming machine 100 may be any type of gaming machine, and may include, without limitation, different structures than those shown in FIG. 1. Moreover, gaming machine 100 may employ different methods of operation than those described below.

In the exemplary embodiment, gaming machine 100 includes a cabinet 102 configured to house a plurality of components, such as a gaming machine controller, peripheral devices, presentation devices, and player interaction devices. For example, in an exemplary embodiment, gaming machine 100 includes a plurality of input devices, such as switches and/or buttons 104 that are coupled to a front 106 of cabinet 102. Buttons 104 may be used to start play of a primary or secondary game. One button 104 may be a "Bet One" button that enables the player to place a bet or to increase a bet. Another button 104 may be a "Bet Max" button that enables the player to bet a maximum permitted wager. Yet another button 104 may be a "Cash Out" button that enables the player to receive a cash payment or other suitable form of payment, such as a ticket or voucher, which corresponds to a number of remaining credits.

In the exemplary embodiment, gaming machine 100 also includes a coin acceptor 108 for accepting coins and/or tokens, and a bill acceptor 110 for accepting and/or validating cash bills, coupons, and/or ticket vouchers 112. Bill acceptor 110 may also be capable of printing tickets 112. Furthermore, in some embodiments, bill acceptor 110 includes a card reader or validator for use with credit cards, debit cards, identification cards, and/or smart cards. The cards accepted by bill acceptor 110 may include a magnetic strip and/or a preprogrammed microchip that includes a player's identification, credit totals, and any other relevant information that may be used. Moreover, in the exemplary embodiment, gaming machine 100 includes one or more presentation devices 114. Presentation devices 114 are mounted to cabinet 102, and may include a primary presentation device for displaying a primary game and a secondary presentation device for displaying a secondary or bonus game. Presentation devices 114 may include, without limitation, a plasma display, a liquid crystal display (LCD), a display based on light emitting diodes (LEDs), organic light emitting diodes (OLEDs), polymer light emitting diodes (PLEDs), and/or surface-conduction electron emitters (SEDs), a speaker, an alarm, and/or any other device capable of presenting information to a user.

In an exemplary embodiment, presentation device 114 is used to display one or more game images, symbols, and/or indicia such as a visual representation or exhibition of movement of an object (e.g., a mechanical, virtual, or video reel), dynamic lighting, video images, and the like. In an alternative embodiment, presentation device 114 displays images and indicia using mechanical means. For example, presentation device 114 may include an electromechanical device, such as one or more rotatable reels, to display a plurality of game or other suitable images, symbols, or indicia.

In one embodiment, gaming machine 100 randomly generates game outcomes using probability data. For example, each game outcome is associated with one or more probability values that are used by gaming machine 100 to determine the game output to be displayed. Such a random calculation may be provided by a random number generator, such as a true random number generator (RNG), a pseudo-random number generator (PNG), or any other suitable randomization process.

Figure 2:
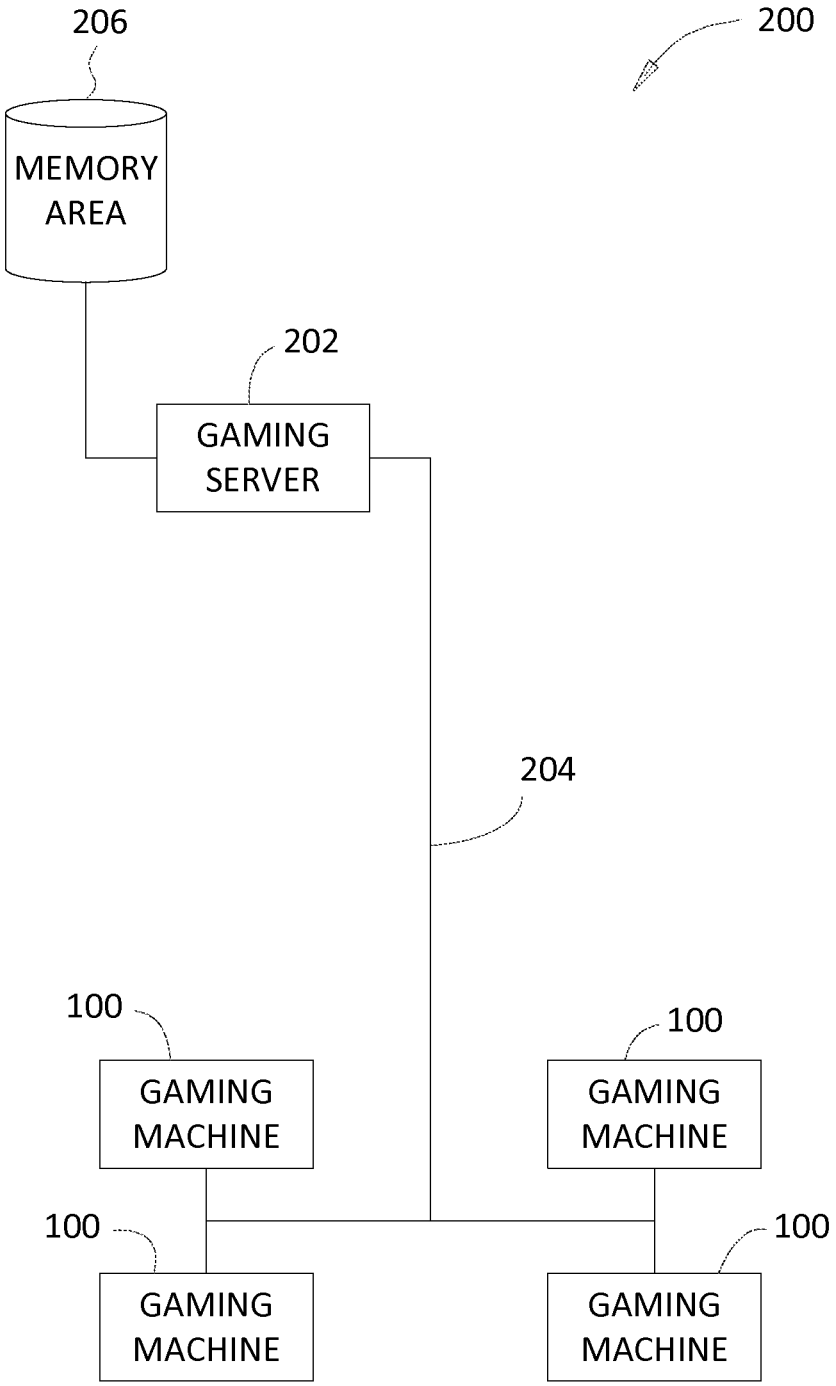
FIG. 2 is a block schematic diagram of an exemplary gaming system that includes a plurality of gaming machines, such as the gaming machine shown in FIG. 1.

FIG. 2 is a block schematic diagram of an exemplary gaming system 200 that includes a plurality of gaming machines, such as gaming machine 100 (shown in FIG. 1). Each gaming machine 100 is coupled via communication interface (not shown in FIG. 2) to one or more servers, such as a gaming server 202, using a network 204. Gaming server 202 includes a processor (not shown) that facilitates data communication between each gaming machine 100 and other components of gaming system 200. Such data is stored in, for example, a memory area 206, such as a database or a file system, which is coupled to gaming server 202.

In one embodiment, one or more gaming machines 100 may be remote gaming machines that access a casino over network 204. As such, a player is able to participate in a game of chance on a remote gaming machine while a player proxy is physically present at, for example, a casino or some other location. In this embodiment, it will be understood that a player operating a remote gaming machine has virtual access to any casino coupled to network 204 and associated with gaming server 202. Further, while gaming machines 100 are described herein as video bingo machines, video poker machines, video slot machines, and/or other similar gaming machines that implement alternative games, gaming machines 100 may also be a personal computers coupled to the Internet or to a virtual private network such that a player may participate in a game of chance remotely. In other embodiments, the player may use a cell phone or other web enabled devices coupled to a communication network to establish a connection with a particular casino. Moreover, gaming machines 100 may be terminal-based machines, wherein the actual games, including random number generation and/or outcome determination, are performed at gaming server 202. In such an embodiment, gaming machines 100 display results of a game via presentation device 114 (shown in FIG. 1).

In one embodiment, gaming server 202 performs a plurality of functions including, for example, game outcome generation, executing a game play event for a player, player proxy selection, player tracking functions, and/or accounting functions, and data authentication functions, to name a few. However, in alternative embodiments, gaming system 200 may include a plurality of servers that separately perform these functions and/or any suitable function for use in a network-based gaming system.

Figure 3:
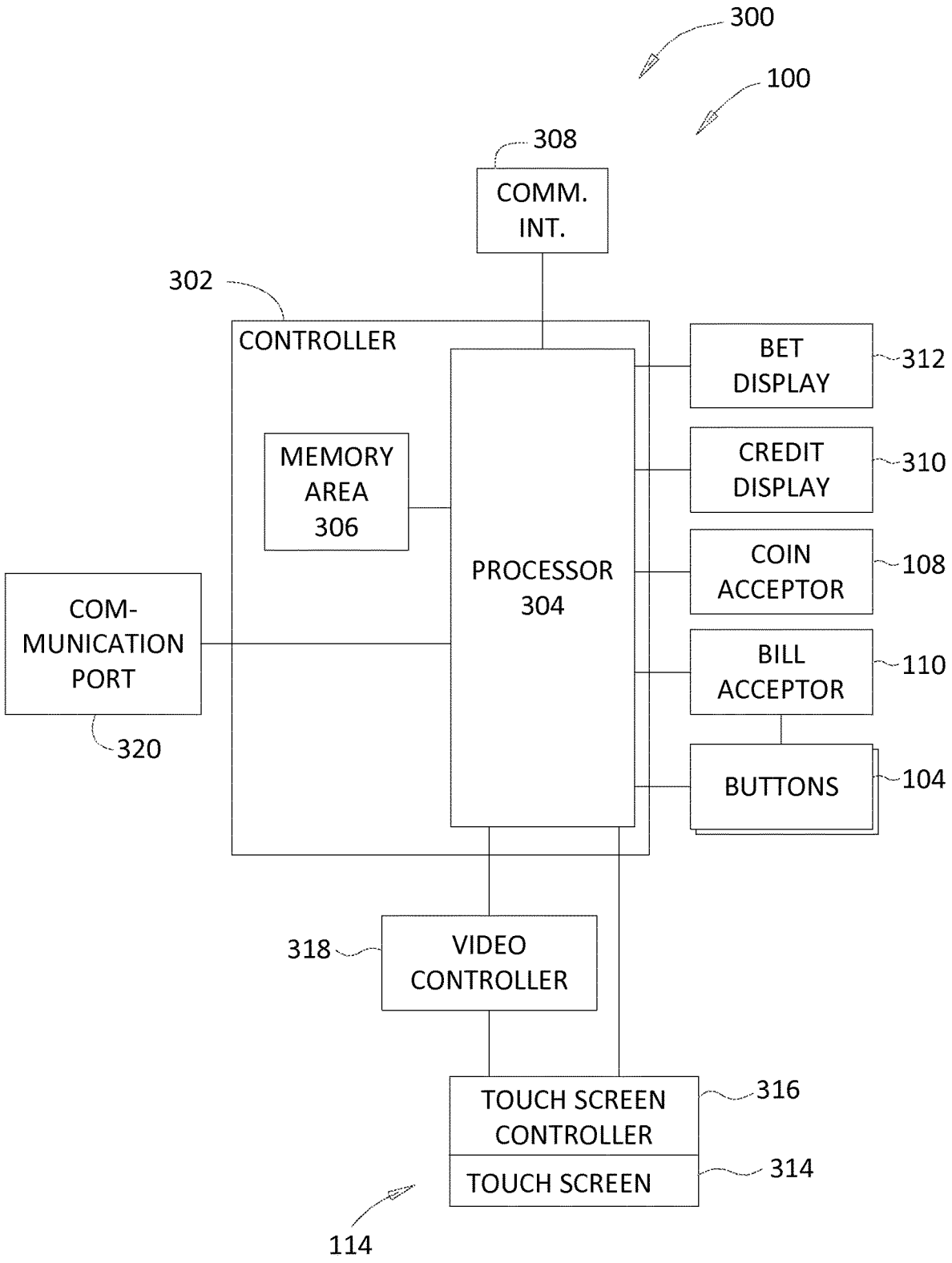
FIG. 3 is a schematic block diagram of an exemplary electrical architecture that may be used with the gaming machines shown in FIGS. 1 and 2.

FIG. 3 is a schematic block diagram of an exemplary electrical architecture 300 that may be used with gaming machine 100. In the exemplary embodiment, gaming machine 100 includes a gaming machine controller 302 including a processor 304 communicatively coupled to a memory area 306. Moreover, in the exemplary embodiment, processor 304 and memory area 306 reside within cabinet 102 (shown in FIG. 1), and may be collectively referred to herein as a "computer" or "controller." Gaming machine 100 is configurable and/or programmable to perform one or more operations described herein by programming processor 304. For example, processor 304 may be programmed by encoding an operation as one or more executable instructions and providing the executable instructions in memory area 306.

Controller 302 communicates with one or more other gaming machines 100, gaming servers 202 (shown in FIG. 2), or other suitable devices via a communication interface 308. Communication interface 308 may operate as an input device (e.g., by receiving data from another device) and/or as an output device (e.g., by transmitting data to another device). Processor 304 may be a microprocessor, a microcontroller-based platform, a suitable integrated circuit, and/or one or more application-specific integrated circuits (ASICs). However, the above examples are exemplary only, and thus are not intended to limit in any way the definition and/or meaning of the term "processor."

Memory area 306 stores at least program code and instructions, executable by processor 304, for controlling gaming machine 100. For example, memory area 306 stores data such as image data, event data, player input data, random or pseudo-random number generation software, pay table data, trigger event conditions, game play events, a list of predefined periods of time to execute the game play events, game play outcomes, data authentication functionality, and/or other information or applicable game rules that relate to game play on gaming machine 100. Moreover, memory area 306 may include one or more forms of memory. For example, memory area 306 can include random access memory (RAM), read-only memory (ROM), flash memory, and/or electrically erasable programmable read-only memory (EEPROM). In some embodiments, other suitable magnetic, optical, and/or semiconductor-based memory may be included in memory area 306 by itself or in combination. In one embodiment, the above data and program code and instructions, executable by processor 304 for authenticating data may be stored and executed from a memory area remote from computing device gaming machine 100. For example, the data and the computer-executable instructions may be stored in a cloud service, a database, or other memory area accessible by gaming machine 100. Such embodiments reduce the computational and storage burden on gaming machine 100. As such, memory area 306 may be a local and/or a remote computer storage media including memory storage devices.

In the exemplary embodiment, gaming machine 100 includes a credit display 310, which displays a player's current number of credits, cash, account balance or the equivalent. Gaming machine 100 also includes a bet display 312, which displays a player's amount wagered. Credit display 310 and bet display 312 may be standalone displays independent of presentation device 114, or credit display 310 and bet display 312 may be incorporated into presentation device 114.

Moreover, in an exemplary embodiment, presentation device 114 is controlled by controller 302. In some embodiments, presentation device 114 includes a touch screen 314 and an associated touch screen controller 316. In such embodiments, presentation device 114 may operate as an input device in addition to presenting information. A video controller 318 is communicatively coupled to controller 302 and touch screen controller 316 to enable a player to input game play decisions (e.g., actions) into gaming machine 100 via touch screen 314. Furthermore, gaming machine 100 includes one or more communication ports 320 that enable controller 302 to communicate with external peripheral devices (not shown) such as, but not limited to, external video sources, expansion buses, other displays, a SCSI port, or a key pad.

Figure 4:
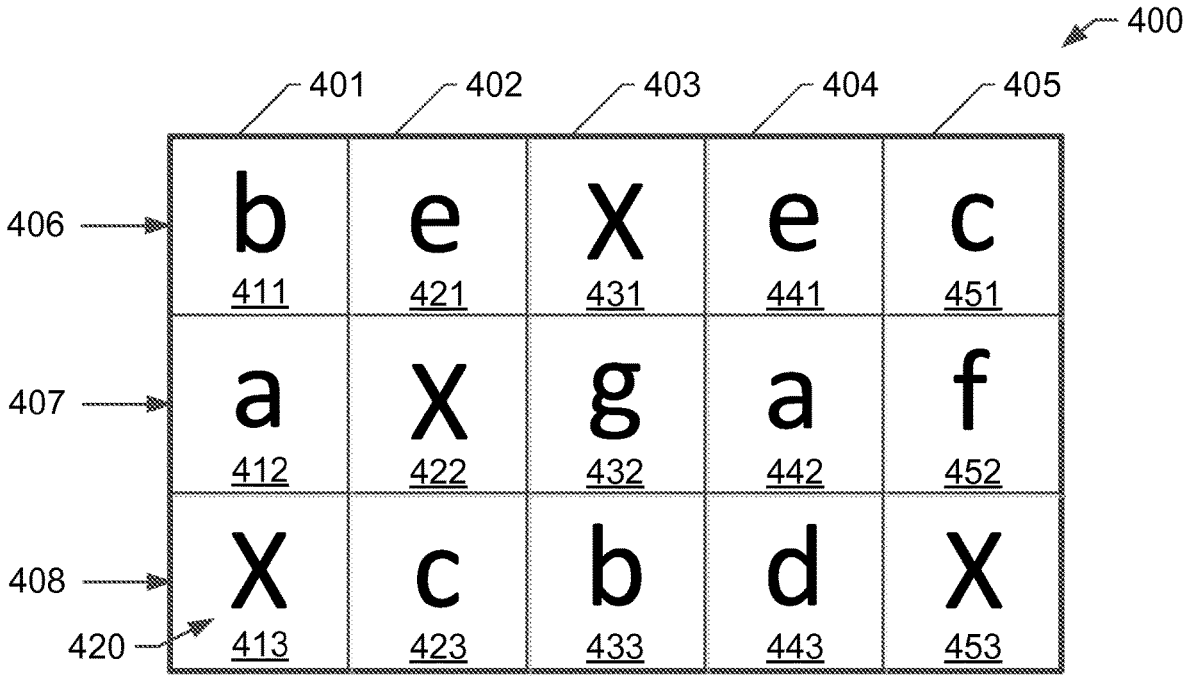
FIG. 4 is a screen view of an exemplary game of chance provided on primary display that includes splitting symbols.

FIG. 4 is a screen view 400 of an exemplary game of chance provided on primary display 114 that includes splitting symbols. In the example embodiment, the game of chance includes five reels (not completely shown), physical, virtual, or otherwise. Each reel includes a plurality of symbol positions, wherein each symbol position is associated with at least one particular symbol. A play of the game of chance, in some embodiments, includes at least one simulated spin of one or more of the reels. Each spin results in the display of three contiguous symbol positions of each virtual reel, illustrated here by columns 401, 402, 403, 404, and 405, such that one symbol for each reel is displayed in each row 406, 407, or 408 of view 400. Further, each individual symbol position in screen view 400 is individually identified. For example, first column 401 includes a top position 411, a middle position 412, and a bottom position 413, and so on for second through fifth columns 402, 403, 404, and 405. It should be understood that more or less reels may be used, and more or less positions per reel may be shown in the play area within the scope of this disclosure.

In the example embodiment, all five reels are "virtual reels" simulated by gaming machine 100 (shown in FIG. 1) during the game of chance. In other words, and for example, the five reels are generated by gaming machine 100 (shown in FIG. 1) in memory prior to game play. As such, each position displayed on the display may be modified or overwritten by gaming machine 100 during the course of gameplay. In this example, the game of chance uses a pre-determined set of symbols ("symbol set") to populate the five reels: "a", "b", "c", "d", "e", "f", "g", and "X". The "X" symbol of these examples is a "splitting symbol", as further described herein. In some embodiments, there may be a plurality of splitting symbols (e.g., there may be other symbols in the symbol set that also have the splitting property). Further, in some embodiments, the "X" symbol is also special symbol, such as a "wild" symbol, a "scatter" symbol, or a "major" symbol that may have other significance or importance in the context of the game of chance (e.g., of greater value with respect to determining rewards or awards). It should be understood that the symbols used in this example symbol set are chosen merely for purposes of discussion. Any symbols may be used as symbol set, and any one or more of those symbols may be implemented as a splitting symbol.

The process of "splitting" a symbol, in one embodiment, includes first activating one particular splitting symbol. In this example embodiment, the splitting property of splitting symbols is dormant until activated. A particular splitting symbol (e.g., the symbol "X") becomes "activated" when one or more of those splitting symbols is exposed on the first reel after a spin. For example, gaming machine 100 spins the five reels during a first spin to generate a plurality of exposed symbol positions such as shown in screen view 400. After the first spin is complete (e.g., entirely displayed to the user), gaming machine 100 determines that a splitting symbol "X" is exposed on first reel 401 (e.g., in symbol position 413). As such, gaming machine 100 activates the splitting property of the symbol "X". In other words, that particular splitting symbol "X" becomes the "activated splitting symbol" 420.

In some embodiments, during the spinning of the reels, one or more new reels may be revealed with already-split symbols appearing on the reels during the reel spin. In other words, the reels may stop with already-split symbols populated on the play area. In some embodiments, one or more of the activated splitting symbols may alter identity or appearance (e.g., during reelspin, prior to splitting) to visually indicate to the player that those symbols may be split if they are exposed in the play area, thus providing enhanced anticipation on the part of the player.

Figure 5:
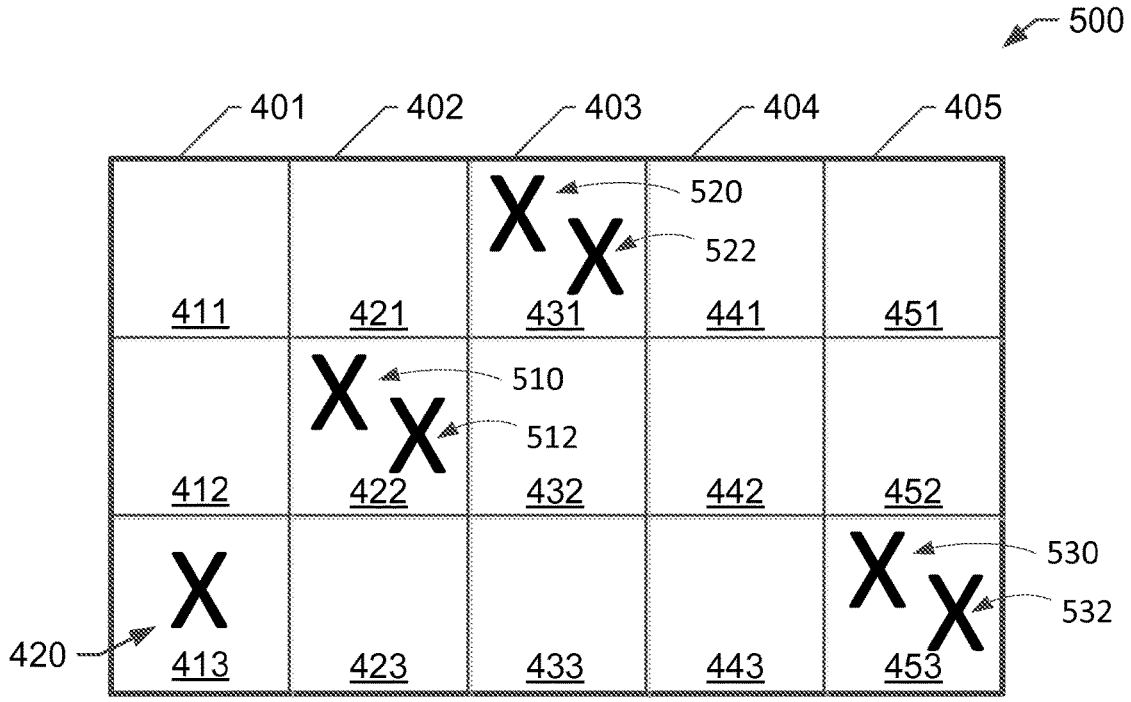
FIG. 5 is a screen view of an exemplary game of chance provided on primary display that includes splitting symbols, such as activated splitting symbol.

FIG. 5 is a screen view 500 of an exemplary game of chance provided on primary display 114 that includes splitting symbols, such as activated splitting symbol 420. Screen view 500, in this example, illustrates a display similar to screen view 400 (shown in FIG. 4), but with only the positions having activated splitting symbols shown for purposes of illustration. In other words, FIG. 5 only shows the positions that include an "X" after the first spin, as described above (e.g., positions 413, 422, 431, and 453).

As described above, the splitting symbol "X" is the activated splitting symbol. In the example embodiment, gaming machine 100 splits all other activated splitting symbols that are exposed on the play field after the spin (e.g., positions 422, 431, and 453). In one embodiment, "splitting" a splitting symbol includes displaying an additional splitting symbol in the same position. For example, if "X" is the activated splitting symbol, and an original "X" 510 appears on the second reel 402 (e.g., in position 422 as shown in FIG. 5), gaming machine 100 splits that original "X" 510 into two "X's" by displaying (e.g., adding) an additional "X" 512 in that same position (e.g., position 422). Similarly, gaming machine 100 also splits original "X" 520 and 530 into additional "X" 522 and 532 in their respective positions 431 and 453. In some embodiments, gaming machine 100 may also split the first-reel splitting symbol 420.

In the example shown in FIG. 5, the additional symbol 512, 522, and 532 added during the splitting process is another splitting symbol (e.g., another "X"). As such, once the splitting process is complete, each position subject to splitting (e.g., positions 422, 431, and 453) contains two splitting symbols. In other embodiments, gaming machine 100 may add a different symbol. For example, in one embodiment, gaming machine 100 may add a symbol related to activated splitting symbol 420. In a fishing game, for example, if the activated splitting symbol is a fishing pole, the related symbols could be a fish, a lure, a net, etc.

As such, when the gaming machine 100 processes awards (e.g., evaluating pay lines), at least some awards may take into account both symbols within that single position, and may provide greater rewards based on the additional symbol provided by the split.

In some embodiments, multiple splitting symbols may be activated. For example, in one embodiment, multiple splitting symbols may be activated by appearing on first reel 401 during the first spin. In another embodiment, a first splitting symbol may be activated on the first spin (e.g., "X" as described in reference to FIGS. 4 and 5), and a second, different splitting symbol may be activated by appearing on first reel 401 during the second spin (presuming the first reel is spun as well). As such, multiple splitting symbols may be split and/or may generate sticky positions.

In some embodiments, the splitting process may not necessarily be performed on all activated splitting symbols. For example, an activated splitting symbol may only split on a certain percentage chance, such as a 50% chance. In other embodiments, a splitting symbol appearing on first reel 401 may not necessarily activate that splitting symbol. For example, in one embodiment, a splitting symbol appearing on first reel 401 may only be activated on a certain percentage chance, such as 70% chance of activating. In some embodiments, only some splitting symbols on first reel 401 have the splitting property. For example, first reel 401 may include 4 "X" symbols, but only 2 of them may be designated with the splitting property.

In some embodiments, activation of a splitting symbol may occur for conditions other than appearing on first reel 401. For example, activation of a particular splitting symbol may occur if a certain number of the splitting symbol are exposed on the play area, or if a splitting symbol appears in a particular position, or in a particular row or column. In another example, activation of a particular splitting symbol may occur only if, during a prior spin, a particular number of the splitting symbol appears in the play area, or in a particular pay line.

Figure 6A:
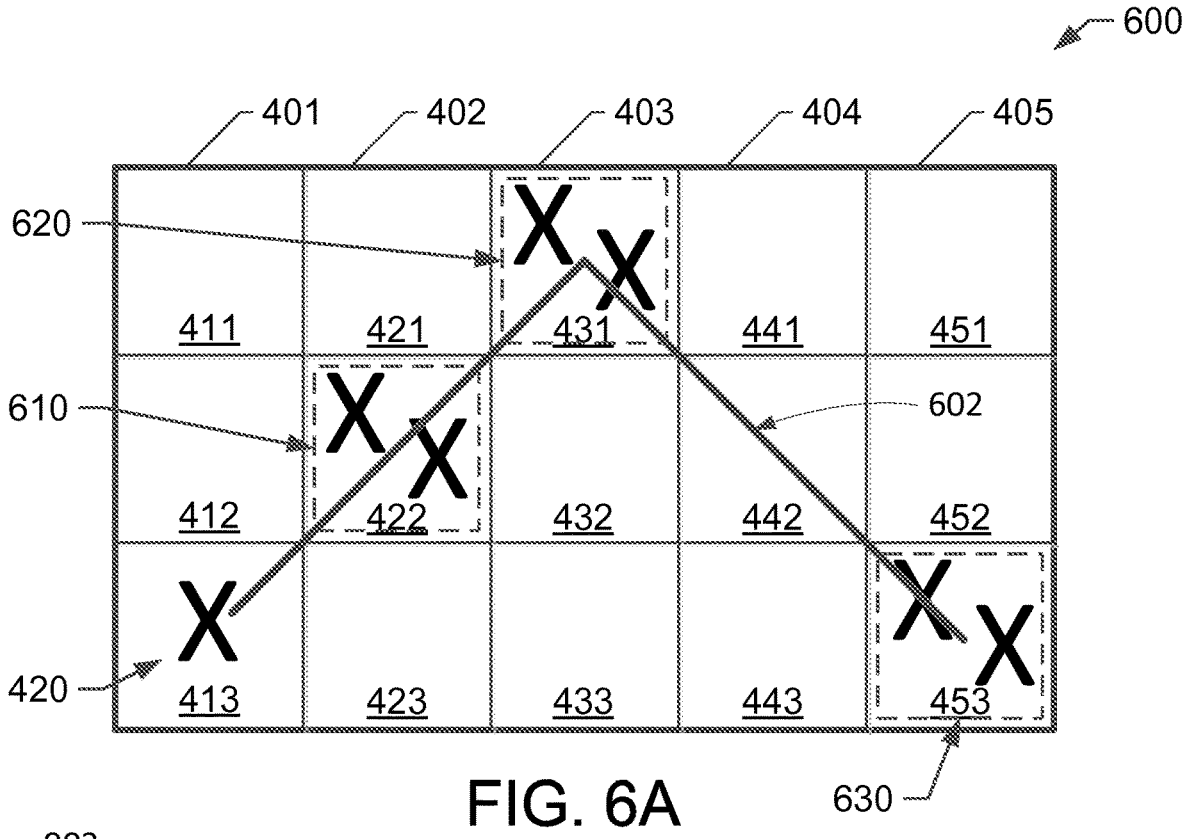
FIG. 6A is a screen view of a pay line illustrated over screen view shown in FIG. 5.

FIG. 6A is a screen view 600 of a pay line 602 illustrated over screen view 500 (shown in FIG. 5). In the exemplary embodiment, the game of chance provided by gaming machine 100 includes a plurality of pay lines such as pay line 602. During play, after the first spin and splitting as shown and described in reference to FIGS. 4 and 5 above, gaming machine 100 evaluates the plurality of pay lines and generates rewards or awards for the user. In one embodiment, pay line 602 is evaluated by gaming machine 100 and is awarded based on the number of "X" symbols appearing on the pay line. Prior to splitting, pay line 602 would have only been evaluated as including 4 "X's". After splitting, and as shown in FIG. 6A, pay line 602 is evaluated as including 7 "X's". As such, the player may receive a larger reward, as well as incurring additional excitement based on witnessing the splitting effect and the enhanced potentials that the effect makes possible.

In some embodiments, as shown in FIG. 6A, one or more positions are identified as "sticky" splitting positions 610, 620, and 630 (e.g., positions 422, 431, and 453). In this example embodiment, all positions that were subjected to splitting after the previous spin (e.g., that contained activated splitting symbols that were split, as shown in FIG. 5) are subsequently designated "sticky" splitting positions 610, 620, and 630 for at least one subsequent spin. In other embodiments, one or more sticky symbol positions are randomly determined and highlighted during the spin of the reels. In yet another embodiment, the player maybe offered a chance to select a symbol position that will be designated as sticky prior to commencing the game.

Figure 6B:
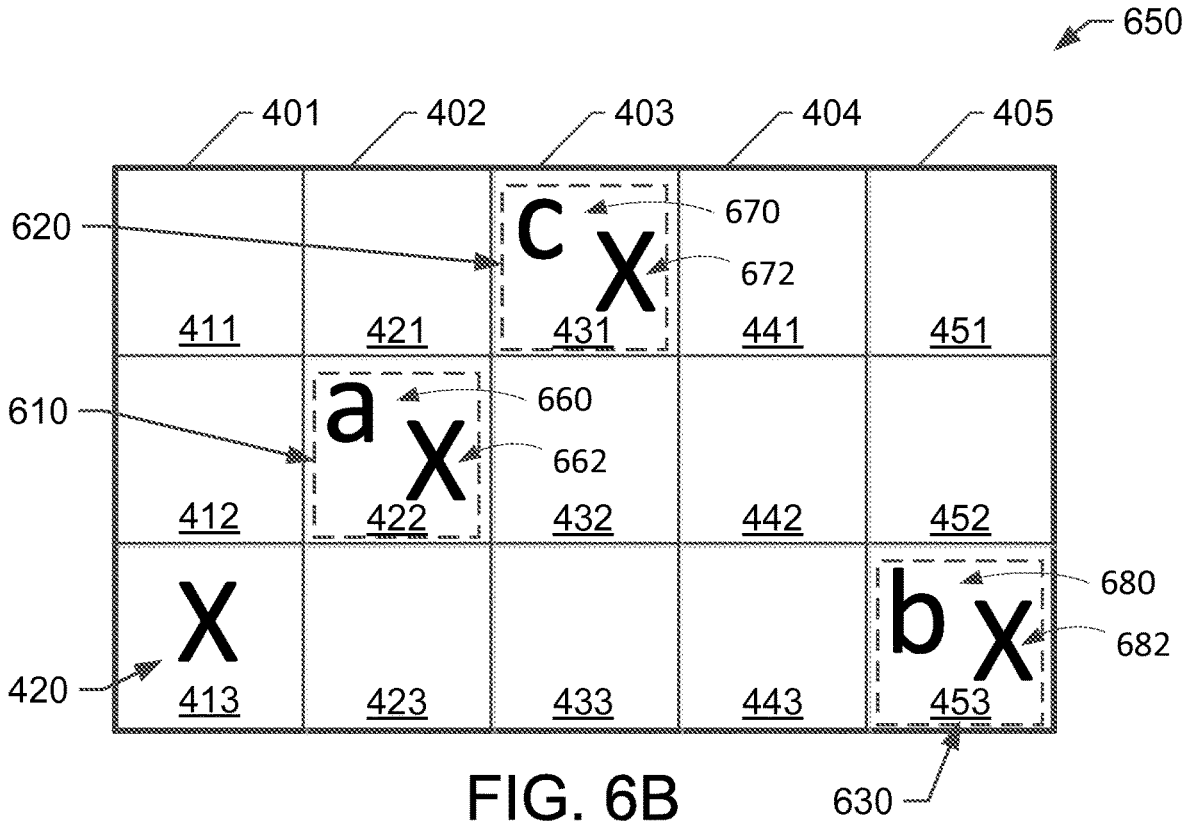
FIG. 6B is a screen view of the game of chance continuing the example described and shown in respect to FIGS. 4, 5, and 6A after a second spin.

FIG. 6B is a screen view 650 of the game of chance continuing the example described and shown in respect to FIGS. 4, 5, and 6A after a second spin. Gaming machine 100 generates another spin similar to the first spin described above. In this second spin, one or more reels spin and re-expose a new play field. "X" continues to be designated as the activated splitting symbol 420. In this example, gaming machine 100 spins the second through fifth reels (e.g., reels 402, 403, 404, and 405). Prior to processing splitting, position 422 displays an original symbol "a" 660 in position 422, an original symbol "c" 670 in position 431, and an original symbol "b" 680 in position 453 after the spin is complete.

In the example embodiment, gaming machine 100 processes splitting of sticky splitting positions 610, 620, and 630. More specifically, gaming machine 100 adds an activated splitting symbol 420 (e.g., "X") to each of sticky splitting positions 610, 620, and 630. In other words, additional symbol 662 is added to position 422, additional symbol 672 is added to position 431, and additional symbol 682 is added to position 453. After sticky splitting is processed, gaming machine 100 may again generate rewards or awards based on the final results after sticky splitting (e.g., as shown in screen view 650).

In the example embodiment, some or all of the steps of the splitting process as described herein may be displayed in a time-delayed fashion, and slow enough such that the player may witness or watch one or more of the splitting steps in sequence. For example, and using the splitting example as described in relation to FIGS. 4 and 5, gaming machine 100 may stop first reel 401 at time t=0.0 seconds and visually highlight splitting symbol 420 in position 413 for 0.2 seconds (e.g., to visually attract the attention to the activation of that symbol as the splitting symbol) while the other reels 402, 403, 404, and 405 are still spinning. Gaming machine 100 may then stop spinning second reel 402 (e.g., at time t=0.2 seconds) and visually display the splitting of original splitting symbol 510 into the additional splitting symbol 512 in position 422 for 0.2 seconds. Gaming machine may then stop subsequent reels 403, 404, and 405 and show splitting in similar fashion. As such, play experience for the player may be enhanced by the player following the splitting action.

In some embodiments, one or more symbols are predefined (e.g., identified prior to spinning) as splitting symbols. In other embodiments, the player selects which symbol is a splitting symbol. In still other embodiments, one or more symbols become splitting symbols during game play. In one embodiment, a wild symbol is a splitting symbol. In another embodiment, one or more symbols are randomly selected to be splitting symbols.

In some embodiments, the final outcome of the splitting process is pre-determined, or pre-scripted. For example, the gaming machine may pre-determine an award and/or a game outcome from a central game server, such as a Bingo server, sent to the game terminal. The final game outcome, instead of being displayed as a Bingo game result, may be displayed as a slot-machine like representation at the game terminal (e.g., spinning reels that sequentially stop), followed by a splitting sequence that achieves this pre-determined outcome. In other words, the centrally determined Bingo game outcome is represented as a slot game with splitting symbols. In other embodiments, the entire outcome of the game and the splitting process may be randomly generated locally by a Random Number Generator (RNG) at the game terminal instead of a centralized server. For example, a slot game result may be identified or generated in real time at the game terminal, followed by a splitting sequence that is also generated and presented in real time at the game terminal.

Figure 7:
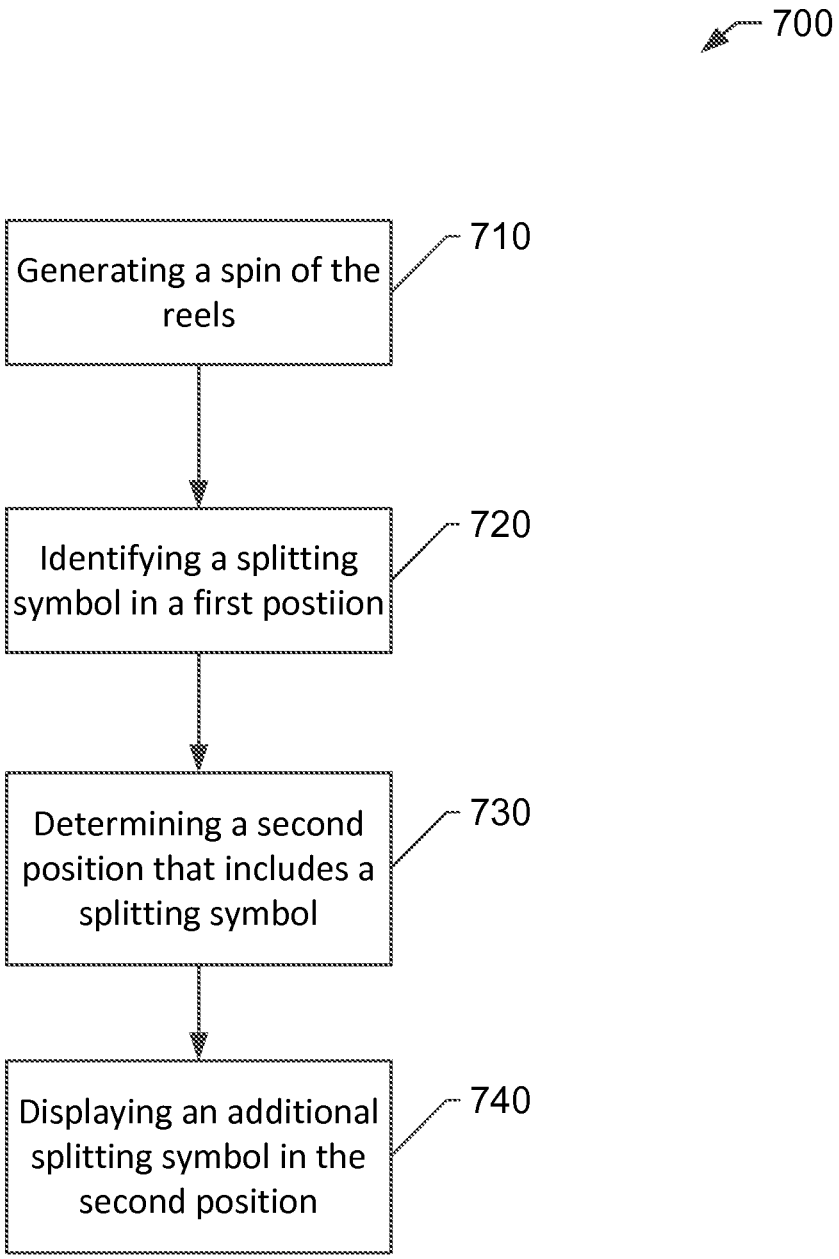
FIG. 7 is a flowchart that illustrates an exemplary method for providing a game of chance on the gaming machine shown in FIG. 1.

FIG. 7 is an exemplary method 700 for providing a game of chance on gaming machine 100 including splitting symbols. In the exemplary embodiment, method 700 is performed by a computing device including a processor and a memory, such as gaming machine 100 shown and described in reference to FIGS. 1-3. In some embodiments, one or more operations in method 700 may be performed by one or more gaming machines 100, by gaming server 202 (shown in FIG. 2), and/or by any other computing device or combination thereof.

In the example embodiment, method 700 includes generating 710 a spin of the plurality of reels, the spin resulting in a play area including one or more symbols generated from each of the plurality of reels. Method 700 also includes identifying 720 a splitting symbol in a first position on the play area, thereby activating the splitting symbol. In some embodiments, activating the splitting symbol further includes activating the splitting symbol further based at least in part on a random number and a pre-determined chance of activation.

Method 700 also includes determining 730 a second position on the play area that includes the splitting symbol as a result of the spin. Method 700 further includes displaying 740 an additional splitting symbol in the second position. In some embodiments, displaying 740 the additional splitting symbol further includes displaying the additional splitting symbol in the second position prior to completion of the spin.

In some embodiments, identifying 720 a splitting symbol further includes identifying a splitting symbol in a first position on a first reel of the plurality of reels, and determining 730 a second position on the play area further includes determining a second position not on the first reel. In some embodiments, method 700 also includes evaluating the play area to determine an award for the player, wherein the evaluation includes the additional splitting symbol.

In some embodiments, method 700 includes identifying a second splitting symbol in a third position on the play area, thereby activating the second splitting symbol, determining a fourth position on the play area that includes a second splitting symbol as a result of the spin, and displaying an additional second splitting symbol in the fourth position. In some embodiments, method 700 includes identifying the second position as a sticky position, generating a second spin of the plurality of reels, and displaying an additional splitting symbol in the second position as a result of the second spin.

Figure 8:
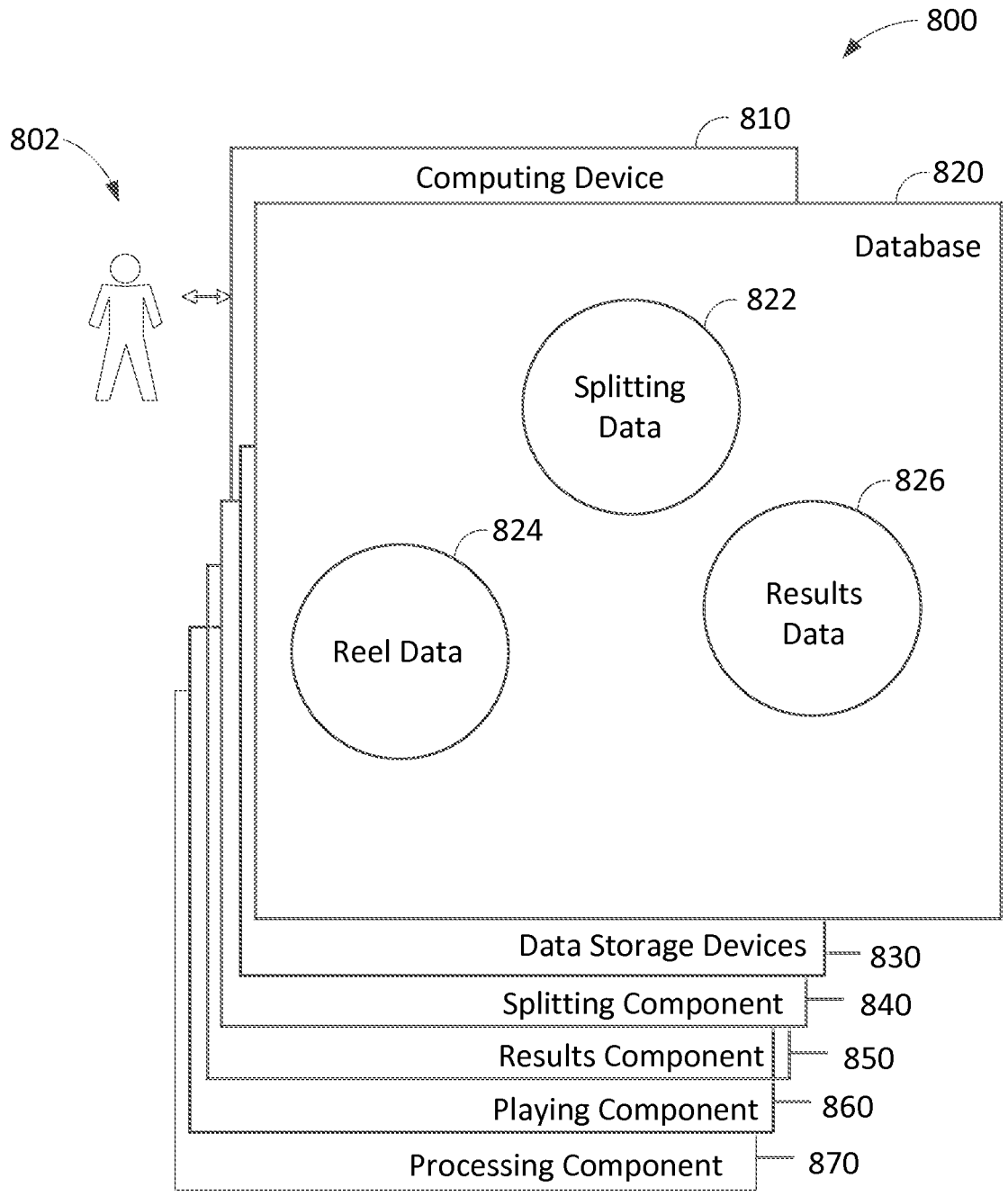
FIG. 8 shows an exemplary configuration of a database within a computing device, along with other related computing components, that provides a play of a base game that includes splitting symbols.

FIG. 8 shows an exemplary configuration 800 of a database 820 within a computing device 810, along with other related computing components, that provides a play of a base game that includes splitting symbols. In some embodiments, computing device 810 is similar to gaming machine 100 (shown in FIG. 1). Database 820 may be coupled to several separate components within computing device 810, which perform specific tasks.

In the example embodiment, database 820 includes splitting data 822, reel data 824, and results data 826. In some embodiments, database 820 is similar to memory area 306 (shown in FIG. 3). Splitting data 822 includes data such as splitting symbol(s), sticky positions, and data related to splitting symbols. Reel data 824 includes data such as a pre-defined circular sequence of symbols simulating a reel of a game of chance. Results data 826 includes information associated with results generated or determined for spins and/or splitting during a game of chance.

Computing device 810 includes the database 820, as well as data storage devices 830. Computing device 810 also includes a splitting component 840 for processing splitting associated with splitting symbols. Computing device 810 also includes a results component 850 for determining results of games of chance. A playing component 860 is also included for providing a game of chance to a user 802 (e.g., a player of the game of chance). A processing component 870 assists with execution of computer-executable instructions associated with the authentication system.

The systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

A computer, controller, or server, such as those described herein, includes at least one processor or processing unit and a system memory. The computer, controller, or server typically has at least some form of computer readable media. By way of example and not limitation, computer readable media include computer storage media and communication media. Computer storage media include volatile and nonvolatile, removable and non-removable media implemented in any method or technology for storage of information such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Combinations of any of the above are also included within the scope of computer readable media.

Although the present disclosure is described in connection with an exemplary gaming system environment, embodiments of the present disclosure are operational with numerous other general purpose or special purpose gaming system environments or configurations. The gaming system environment is not intended to suggest any limitation as to the scope of use or functionality of any aspect of the disclosure. Moreover, the gaming system environment should not be interpreted as having any dependency or requirement relating to any one or combination of components illustrated in the exemplary operating environment.

Embodiments of the present disclosure may be described in the general context of computer-executable instructions, such as program components or modules, executed by one or more computers or other devices. Aspects of the present disclosure may be implemented with any number and organization of components or modules. For example, aspects of the present disclosure are not limited to the specific computer-executable instructions or the specific components or modules illustrated in the figures and described herein. Alternative embodiments of the present disclosure may include different computer-executable instructions or components having more or less functionality than illustrated and described herein.

The order of execution or performance of the operations in the embodiments of the present disclosure illustrated and described herein is not essential, unless otherwise specified. That is, the operations may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the present disclosure.

In some embodiments, the term "database" refers generally to any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, PostgreSQL, and SQLite. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

When introducing elements of aspects of the present disclosure or embodiments thereof, the articles "a," "an," "the," and "said" are intended to mean that there are one or more of the elements. The terms "comprising," including," and "having" are intended to be inclusive and mean that there may be additional elements other than the listed elements.

The present disclosure uses examples to disclose the best mode, and also to enable any person skilled in the art to practice the claimed subject matter, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A gaming machine for providing a game of chance operable upon a wager by a player, said gaming machine comprising:

a display device defining a play area that displays a plurality of reels, each reel of the plurality of reels including a plurality of symbol positions;

a credit input mechanism operable to receive a credit input; and a processor executing instructions stored on a memory which cause the processor to at least:

initiate a spin of the plurality of reels in response to receiving a credit wager, the spin resulting in a random selection of a subset of symbols displayed on the plurality of reels;

determine that a first occurrence of a splitting symbol is displayed at a first symbol position on a first reel of the plurality of reels;

detect each second occurrence of the splitting symbol displayed within one or more symbol positions of a subset of reels of the plurality of reels, wherein the subset of reels includes at least two reels of the plurality of reels and excludes the first reel of the plurality of reels and each reel of the subset of reels is positioned to the right of the first reel;

activate a splitting symbol feature to be applied to each of the one or more symbol positions of the subset of reels in response to determining the first occurrence of the splitting symbol displayed at the first symbol position on the first reel and in response to detecting one or more second occurrences of the splitting symbol at the one or more symbol positions of the subset of reels;

in response to activation of the splitting symbol feature, insert an additional symbol into each of the one or more symbol positions on the subset of reels but not the first symbol position on the first reel, such that the first symbol position includes only the first occurrence of the splitting symbol, and such that each of the one or more symbol positions includes one of the one or more second occurrences of the splitting symbol and the additional symbol; and determine an award, if any, based at least in part on the first occurrence of the splitting symbol, the one or more second occurrences of the splitting symbol, and each additional symbol.

2. The gaming machine in accordance with claim 1, wherein the one or more second occurrences of the splitting symbol includes a plurality of second occurrences and the one or more symbol positions includes a plurality of symbol positions of the subset of reels, each second occurrence being displayed in a corresponding unique symbol position of the subset of reels, wherein the processor is further programmed to control the display device to simultaneously display only the splitting symbol in the first symbol position on the first reel and to display, in each of the plurality of symbol positions on the subset of reels, the corresponding second occurrences of the splitting symbol and the additional symbol.

3. The gaming machine in accordance with claim 1, wherein the processor is further programmed to activate the splitting symbol feature further based at least in part on a random number and a pre-determined chance of activation.

4. The gaming machine in accordance with claim 1, wherein the processor is further programmed to:

initiate a second spin of the plurality of reels;

maintain the one of the one or more second occurrences of the splitting symbol, but not the additional symbol, in each of one or more symbol positions on the subset of reels during and after the second spin; and replace, for each of the one or more symbol positions, the additional symbol with another additional symbol.

5. The gaming machine in accordance with claim 1, wherein the processor is further programmed to control the display device to display the additional symbol in each of the one or more symbol positions of the subset of reels as the second reel spins.

6. The gaming machine in accordance with claim 1, wherein the additional symbol is a duplicate of the splitting symbol.

7. The gaming machine in accordance with claim 1, wherein the additional symbol is different from the splitting symbol.

8. A method for providing a wagering game operable upon a wager by a player, the method carried out on a gaming machine including a display device configured to display the wagering game, a player input interface, a credit input, and a processor, the display device further configured to display a plurality of reels, each reel of the plurality of reels comprising respective pluralities of symbol positions configured to display respective symbols thereon, the display device defining a play area in which the plurality of reels are displayed, the method comprising:

initiating a spin of the plurality of reels in response to receiving a credit wager, the spin resulting in a random selection of a subset of symbols displayed from the respective symbols on the plurality of reels;

determining that a first occurrence of a splitting symbol is displayed at a first symbol position on a first reel of the plurality of reels;

detecting each second occurrence of the splitting symbol displayed within one or more symbol positions of a subset of reels of the plurality of reels, wherein the subset of reels includes at least two reels of the plurality of reels and excludes the first reel of the plurality of reels and each reel of the subset of reels is positioned to the right of the first reel;

activating a splitting symbol feature to be applied to each of the one or more symbol positions of the subset of reels in response to determining the first occurrence of the splitting symbol displayed at the first symbol position on the first reel and in response to detecting one or more second occurrences of the splitting symbol at the one or more symbol positions of the subset of reels;

in response to the activation of the splitting symbol feature, inserting an additional symbol into each of the one or more symbol positions on the subset of reels but not the first symbol position on the first reel, such that the first symbol position includes only the first occurrence of the splitting symbol, and such that each of the one or more symbol positions includes one of the one or more second occurrences of the splitting symbol and the additional symbol; and determining an award, if any, based at least in part on the first occurrence of the splitting symbol, the one or more second occurrences of the splitting symbol, and each additional symbol.

9. The method in accordance with claim 8, wherein the one or more second occurrences of the splitting symbol includes a plurality of second occurrences and the one or more symbol positions includes a plurality of symbol positions of the subset of reels, each second occurrence being displayed in a corresponding unique symbol position of the subset of reels, wherein the method further comprises controlling the display device to simultaneously display only the splitting symbol in the first symbol position on the first reel and to display, in each of the plurality of symbol positions on the subset of reels, the corresponding second occurrences of the splitting symbol and the additional symbol.

10. The method in accordance with claim 8, wherein activating the splitting symbol further includes activating the splitting symbol feature further based at least in part on a random number and a pre-determined chance of activation.

11. The method in accordance with claim 8 further comprising:

initiating a second spin of the plurality of reels;

maintaining the one of the one or more second occurrences of the splitting symbol, but not additional symbol, in each of one or more symbol positions on the subset of reels during and after the second spin; and replace, for each of the one or more symbol positions, the additional symbol with another additional symbol.

12. The method in accordance with claim 8 further comprising displaying the additional symbol in each of the one or more symbol positions of the subset of reels as the second reel spins.

13. A gaming system comprising:

a gaming machine comprising:

a credit input mechanism operable to receive a credit input; and a display device defining a play area that displays a plurality of reels, each reel of the plurality of reels including a plurality of symbol positions; and a server coupled to the gaining machine, the server comprising a processor, the processor executing instructions stored on a memory which cause the processor to at least:

initiate a spin of the plurality of reels in response to receiving a credit wager, the spin resulting in in a random selection of a subset of symbols displayed on the plurality of reels;

detect each second occurrence of the splitting symbol displayed within one or more symbol positions of a subset of reels of the plurality of reels, wherein the subset of reels includes at least two reels of the plurality of reels and excludes the first reel of the plurality of reels and each reel of the subset of reels is positioned to the right of the first reel;

activate a splitting symbol feature to be applied to each of the one or more symbol positions of the subset of reels in response to determining the first occurrence of the splitting symbol displayed at the first symbol position on the first reel and in response to detecting the one or more second occurrences of the splitting symbol at the one or more symbol positions of the subset of reels;

in response to activation of the splitting symbol feature, insert an additional symbol into each of the one or more symbol positions on the subset of reels but not the first symbol position on the first reel, such that the first symbol position includes only the first occurrence of the splitting symbol, and such that each of the one or more symbol positions includes one of the one or more second occurrences of the splitting symbol and the additional symbol; and determine an award, if any, based at least in part on the first occurrence of the splitting symbol, the one or more second occurrences of the splitting symbol, and each additional symbol.

14. The gaming system in accordance with claim 13, wherein the one or more second occurrences of the splitting symbol includes a plurality of second occurrences and the one or more symbol positions includes a plurality of symbol positions of the subset of reels, each second occurrence being displayed in a corresponding unique symbol position of the subset of reels, wherein the processor is further programmed to control the display device to simultaneously display only the splitting symbol in the first symbol position on the first reel and to display, in each of the plurality of symbol positions on the subset of reels, the corresponding second occurrences of the splitting symbol and the additional symbol.

15. The gaming system in accordance with claim 13, wherein the processor is further configured to activate the splitting symbol feature further based at least in part on a random number and a pre-determined chance of activation.

16. The gaming system in accordance with claim 13, wherein the processor is further programmed to:

initiate a second spin of the plurality of reels; and maintain the one of the one or more second occurrences of the splitting symbol, but not the additional symbol, in each of one or more symbol positions on the subset of reels during and after the second spin.

17. The gaming system in accordance with claim 13, wherein the processor is further programmed to control the display device of the gaming machine to display the additional symbol in each of the one or more symbol positions of the subset of reels as the second reel spins.

* * * * *